US010631077B2

(12) United States Patent
Cranfield et al.

(10) Patent No.: US 10,631,077 B2
(45) Date of Patent: Apr. 21, 2020

(54) LENGTH-ADJUSTABLE COLLAPSING HEADBAND

(71) Applicants: Zach Cranfield, Fair Haven, NY (US); Eric Michael Bergman, Montara, CA (US)

(72) Inventors: Zach Cranfield, Fair Haven, NY (US); Eric Michael Bergman, Montara, CA (US)

(73) Assignee: Zach Cranfield, Fair Haven, NY (US)

( * ) Notice: Subject to any disclaimer, the term of this patent is extended or adjusted under 35 U.S.C. 154(b) by 0 days.

(21) Appl. No.: 16/383,604

(22) Filed: Apr. 13, 2019

(65) Prior Publication Data

US 2019/0320255 A1 Oct. 17, 2019

Related U.S. Application Data

(60) Provisional application No. 62/657,760, filed on Apr. 14, 2018.

(51) Int. Cl.
*H04R 25/00* (2006.01)
*H04R 1/10* (2006.01)

(52) U.S. Cl.
CPC ..... *H04R 1/105* (2013.01)

(58) Field of Classification Search
CPC ..... H04R 1/105
(Continued)

(56) References Cited

U.S. PATENT DOCUMENTS 2,299,687 A 10/1942 Hiram
3,053,351 A 9/1962 Fulcher
(Continued)

FOREIGN PATENT DOCUMENTS

CN 201315930 Y 9/2009
CN 101906815 A 12/2010
(Continued)

OTHER PUBLICATIONS

Goldberg, Michael, Polyhedral Linkages, National Mathematics Magazine, Apr. 1942, pp. 323-332, vol. 16, No. 7, Mathematical Association of America, Washington, D.C., United States of America.
(Continued)

*Primary Examiner* — Phylesha Dabney
(74) *Attorney, Agent, or Firm* — Kurt Rauschenbach; Rauschenbach Patent Law Group, PLLC

(57) ABSTRACT

A length-adjustable collapsible headphone includes a headband comprising an upper section, a right lower section, and a left lower section, the upper section comprising an inner headband arm and an outer headband arm, the right lower section and the left lower section each comprising a scissor arm assembly having an inner scissor arm and an outer scissor arm, each of the inner scissor arms and the outer scissor arms comprising slide adjustment sub-assemblies. A pivot joint connects the outer headband arm to the inner headband arm so that the outer headband arm and the inner headband arm can rotate freely around an axis of the pivot joint. A left and a right pivot assembly connects respective inner scissor arms to respective outer scissor arms that are aligned with the axis of the pivot joint so as to maintain a common centerpoint allowing the headphone to collapse in a spherical motion to a space efficient closed state. At least one earcup assembly connects to the headband with a yoke using a swivel joint that allows the earcups assembly to yaw around the axis of the swivel joint.

18 Claims, 17 Drawing Sheets

(58) Field of Classification Search
USPC ..... 381/375
See application file for complete search history.

(56) References Cited

U.S. PATENT DOCUMENTS

| | | | | |
|---|---|---|---|---|
| 3,335,815 | A | 8/1967 | Oakes | |
| 3,496,687 | A | 2/1970 | Greenberg et al. | |
| 3,672,104 | A | 6/1972 | Luckey | |
| 3,682,268 | A | 8/1972 | Gorike | |
| 3,700,070 | A | 10/1972 | King | |
| 3,888,056 | A | 6/1975 | Kelly et al. | |
| 3,968,808 | A | 7/1976 | Zeigler | |
| 4,290,244 | A | 9/1981 | Zeigler | |
| 4,404,434 | A | 9/1983 | Pelt et al. | |
| 4,538,034 | A | 8/1985 | French | |
| 4,597,469 | A | 7/1986 | Nagashima | |
| 4,942,700 | A | 7/1990 | Hoberman | |
| 5,024,031 | A | 6/1991 | Hoberman | |
| 5,038,532 | A | 8/1991 | Shahinpoor | |
| 5,448,867 | A | 9/1995 | Wilson | |
| 5,793,878 | A * | 8/1998 | Chang | H04R 5/0335 381/370 |
| 5,862,241 | A * | 1/1999 | Nelson | H04R 1/105 381/374 |
| 5,966,991 | A | 10/1999 | Gosselin et al. | |
| 6,466,681 | B1 * | 10/2002 | Siska, Jr. | H04R 5/0335 381/370 |
| 6,603,863 | B1 | 8/2003 | Nagayoshi | |
| 6,654,966 | B2 | 12/2003 | Rolla | |
| 7,292,703 | B2 | 11/2007 | Kaulfuss et al. | |
| 7,580,539 | B2 | 8/2009 | Tachikawa | |
| 8,737,668 | B1 * | 5/2014 | Blair | H04R 1/1066 381/378 |
| 8,861,770 | B2 * | 10/2014 | Blair | H04R 1/1058 381/378 |
| 2005/0053255 | A1 | 3/2005 | Harris et al. | |
| 2006/0159868 | A1 | 7/2006 | Hoberman et al. | |
| 2008/0175406 | A1 | 7/2008 | Smith | |
| 2012/0014554 | A1 | 1/2012 | Santiago | |

FOREIGN PATENT DOCUMENTS

| | | | |
|---|---|---|---|
| CN | 202435579 | U | 9/2012 |
| CN | 102704608 | A | 10/2012 |
| CN | 202577709 | U | 12/2012 |
| CN | 202577710 | U | 12/2012 |
| CN | 102644352 | B | 4/2014 |
| CN | 104023287 | A | 9/2014 |
| CN | 105340293 | A | 2/2016 |

OTHER PUBLICATIONS

Kassabian, P.E. et al, Retractable Roof Structures, Structures and Buildings Journal, Jan. 1999, pp. 45-56, Institute of Civil Engineers, London, United Kingdom.

https://www.core77.com/posts/79636/The-Future-of-Transportation-Get-Up-and-Go, retrieved Apr. 16, 2019.

https://www.news.aau.dk/news/new-invention-revolutionizes-exoskeletons.cid355473, retrieved Apr. 16, 2019.

* cited by examiner

LENGTH-ADJUSTABLE COLLAPSING HEADBAND

The section headings used herein are for organizational purposes only and should not to be construed as limiting the subject matter described in the present application in any way.

RELATED APPLICATION SECTION

The present application is a non-provisional of copending U.S. Provisional Patent Application Ser. No. 62/657,760, filed Apr. 14, 2018, and entitled "Length-Adjustable Collapsing Headband". The entire contents of U.S. Patent Application Ser. No. 62/657,760 are incorporated herein by reference.

INTRODUCTION

The market for portable audio is large and growing, with applications including music, entertainment, sports, fitness, safety, business and many other. The increasing need for portable audio is driving growth and change in the over-ear speaker market. Many consumers prefer an audio headphone, rather than an in-ear audio, solutions because of improved sound quality, comfort, reduction in background noise, and concerns about hearing loss from in-ear solutions. One challenge with audio headphones is their large size and bulkiness. Headphones do not store easily, especially during travel. Headphones can be easily broken due to their complex shape and because they have features that are oriented perpendicular to one another. As such, improvements are needed to provide headphones that can be configured to be compact, and easily and efficiently stored and carried.

BRIEF DESCRIPTION OF THE DRAWINGS

The present teaching, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teaching in any way.

FIG. 5C illustrates a side-view of the length-adjustable collapsing headphones of

FIG. 5A.

DESCRIPTION OF VARIOUS EMBODIMENTS

Figure 1A:
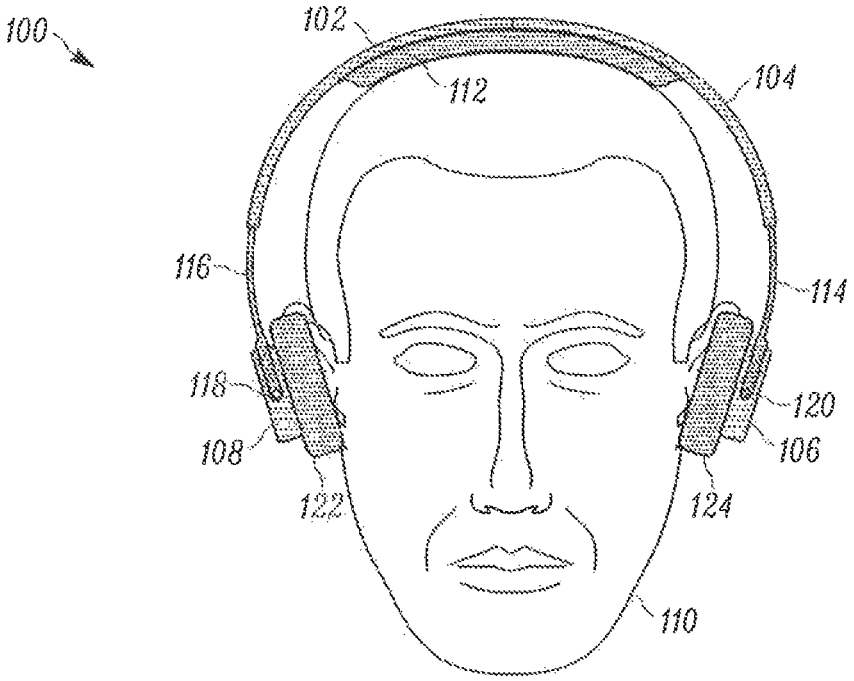
FIG. 1A illustrates a diagram of prior art headphones configured to fit on a relatively large human head.

The present teaching will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications, and equivalents, as will be appreciated by those of skill in the art. Those of ordinary skill in the art having access to the teaching described herein will recognize additional implementations, modifications, and embodiments, as well as other fields of use, which are within the scope of the present disclosure as described herein.

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings can be performed in any order and/or simultaneously as long as the teaching remains operable. Furthermore, it should be understood that the apparatus and methods of the present teachings can include any number or all of the described embodiments as long as the teaching remains operable.

Over-ear headphones are well known to produce better sound, be more comfortable to wear, and support noise cancellation and have other desirable features compared with other personal audio solutions. One challenge with over-ear headphones is that they are bulky. This makes it difficult to store and carry the over-ear headphones. Over-ear headphones generally do not store easily during travel and can be easily broken due to their complex shape and features that are perpendicular to one another. One solution is to provide headphones that can collapse into a smaller package for storage and/or other purposes. The challenge is to provide a collapsible system that is robust, easy to use, comfortable to wear, adjustable, affordable, and easy to manufacture. The length-adjustable collapsible headphones of the present teaching addresses these issues by collapsing into a compact shape that can be more easily packed away and is less likely to be impacted by forces on luggage or baggage experienced during travelling.

The length-adjustable collapsible headphones of the present teaching provide a headphone apparatus that is easy to fold and compact when closed. In the open position, the length-adjustable collapsible headphones are comfortable to wear with an adjustable fit. The length-adjustable collapsible headphones are also designed for ease of manufacture. The length-adjustable collapsible headphones collapsing sequence method according to the present teaching is also easy to perform. In addition, the length-adjustable collapsible headphones can have a built-in mechanism to guide motion and prevent breakage.

It should be understood that the length-adjustable collapsing headphones method and apparatus of the present teaching is not limited to securing audio-speakers to a human head. For example, headphone technology of the present teaching may be used for a variety of other applications including noise reduction, noise cancellation and applications that protect and/or cover the ear for various reasons. Furthermore, as will be appreciated by those skilled in the art, the headband method and apparatus of the present teaching, which is described in relation to securing earcups to a head, can be used to secure other elements to the head or arm. For example, lamps, microphones, antennas, notifications, and other active and passive elements can be secured to a head using straightforward modification to the headband apparatus and method of the present teaching. The result is a more compact, easy to use and robust system for securing an element to a head.

FIG. 1A illustrates a diagram of a prior art headphone system 100 configured to fit on a relatively large human head. This figure is used to illustrate the naming convention of various parts of common headphones. The naming convention described here is intended to broadly define the various elements of headphones and should not be considered as limiting the elements of the present teaching in any way. The headphones 102 include a headband 104 that connects a left earcup 106 to a right earcup 108. The headband 104 serves to hold the earcups 106, 108 in order to comfortably position and secure the earcups 106, 108 to the head 110. The headband 104 can also support wires that run between the earcups 106, 108 and/or to other parts of the headphones 102. There is a headpad 112 positioned under the headband 104 at the top of the head 110 and positioned between the headband 104 and the head 110. The headpad 112 protects and cushions the head 110 from the headband 104. There are optional length adjustment arms 114, 116 that adjustably extend from a lower portion of one or both sides of the headband 104. The earcups 106, 108 are connected to the headband 104 via a variety of connectors 118, 120. These connectors 118, 120 are designed to allow movement of the earcups 106, 108 relative to a position of the headband 104. Earpads 122, 124 are used to cushion and/or insulate the ears. FIG. 1 shows the configuration of the length-adjustable collapsible headphones for a relatively large head 110, where the length adjustment arms 114, 116 are fully extended to allow the earcups 106, 108 to be positioned over the ears.

Figure 1B:
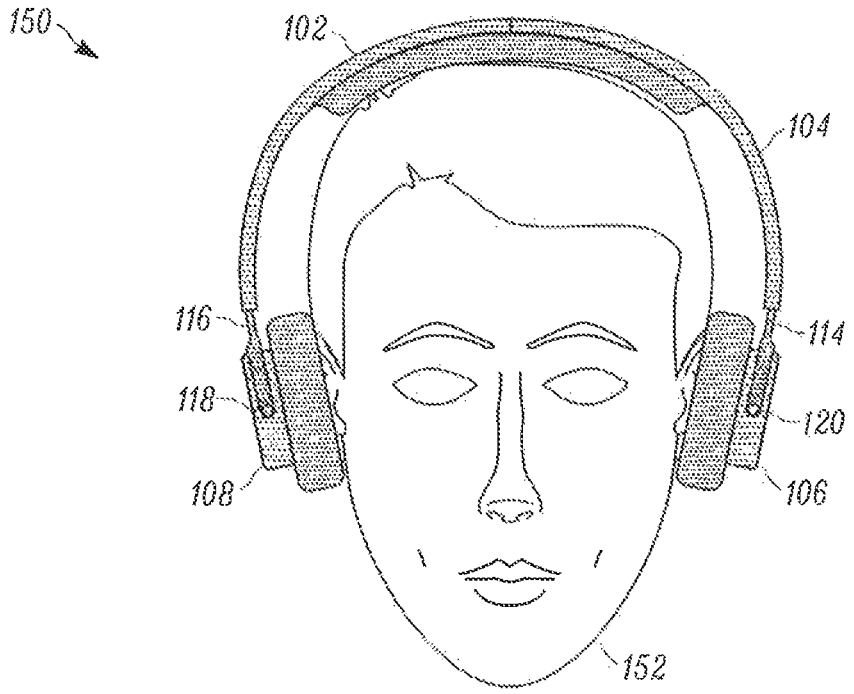
FIG. 1B illustrates a diagram of the prior art headphone system comprising the headphones of FIG. 1A configured to fit on a relatively small human head.

FIG. 1B illustrates a diagram of the prior art headphone system 150 comprising the headphones 102 of FIG. 1A configured to fit on a relatively small human head 152. In this configuration, the length adjuster arms 114, 116 are retracted into the headband 104 to fit the smaller head 152. FIG. 1B also illustrates how the connectors 118, 120 allow the earcups 106, 108 to pivot to adjust to the position of the ears.

Figure 2:
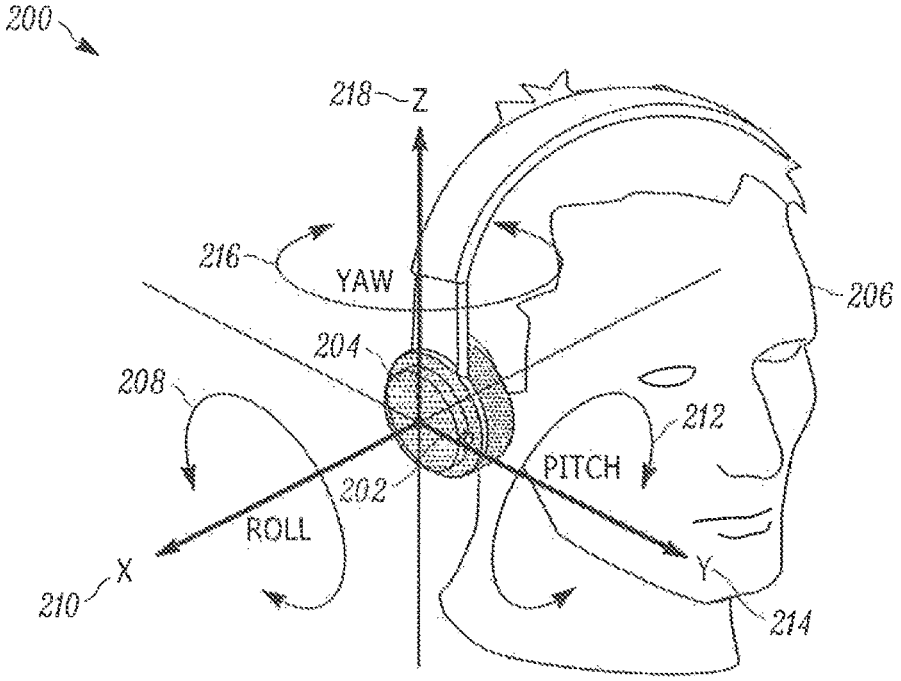
FIG. 2 illustrates a schematic diagram of headphones on a human head showing the convention used for headphone orientation.

FIG. 2 illustrates a schematic diagram 200 of headphones on a human head showing the convention used for headphone orientation. A Cartesian coordinate system 202 is centered on a center of the earpiece 204 on the right side of the head 206. Angles representing roll 208 are rotations around the x-axis 210. Angles representing pitch 212 are rotations around the y-axis 214. Angles representing yaw 216 are rotations around the z-axis 218.

Figure 3:
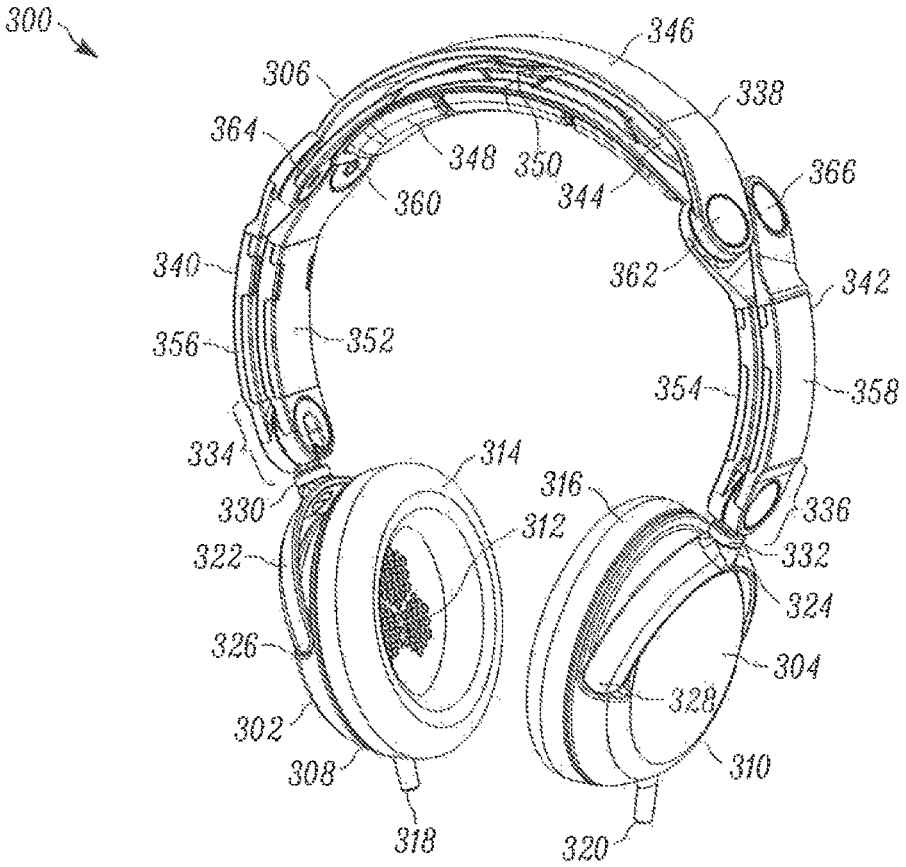
FIG. 3 illustrates an embodiment of length-adjustable collapsing headphones according to the present teaching.

FIG. 3 illustrates an embodiment of a length-adjustable collapsing headphone apparatus 300 according to the present teaching. FIG. 3 illustrates headphones with a right earcup 302 and left earcup 304, however, in some embodiments only a single earcup, right or left, is used. A headband 306 connects to a right earcup assembly 308 and to a left earcup assembly 310. Each earcup assembly 308, 310 contains earcups 302, 304 speakers 312 and cushions 314, 316 that are intended to fit over and/or around an ear. A particular size and shape of earcups 302, 204 and cushions 314, 316 are illustrated, but it is understood that a variety of known earcup and/or cushion shapes and sizes can be utilized. The bottom of the earcup assembly 308, 310 includes a strain relief 318, 320.

The headband 306 connects to each earcup assembly 308, 310 using a yoke 322, 324. Two yoke axels 326, 328 (only one for each side is shown in FIG. 3) are used to connect the yokes 322, 324 to the earcups 302, 304. The yoke axels 326, 328 allow the earcups 302, 304 to pitch around the yoke axels 326, 328. In some embodiments, the yoke 322, 324 can break away, separating the headband from the earcup, since no wires connect through the yoke 322, 324 and swivel to the headband 306. In some embodiments, that are wireless or single wire out of one earcup, the yoke 322, 324 is not able to be separated. The yokes 322, 324 connect to the headband 306 using swivel joints 330, 332. The swivel joints 330, 332 allow the earcups 302, 304 to yaw around the axis of the swivel joints 330, 332. The swivel joints 330, 332 connect to the headband 306 via a keyhole pivot assembly 334, 336.

Figure 4:
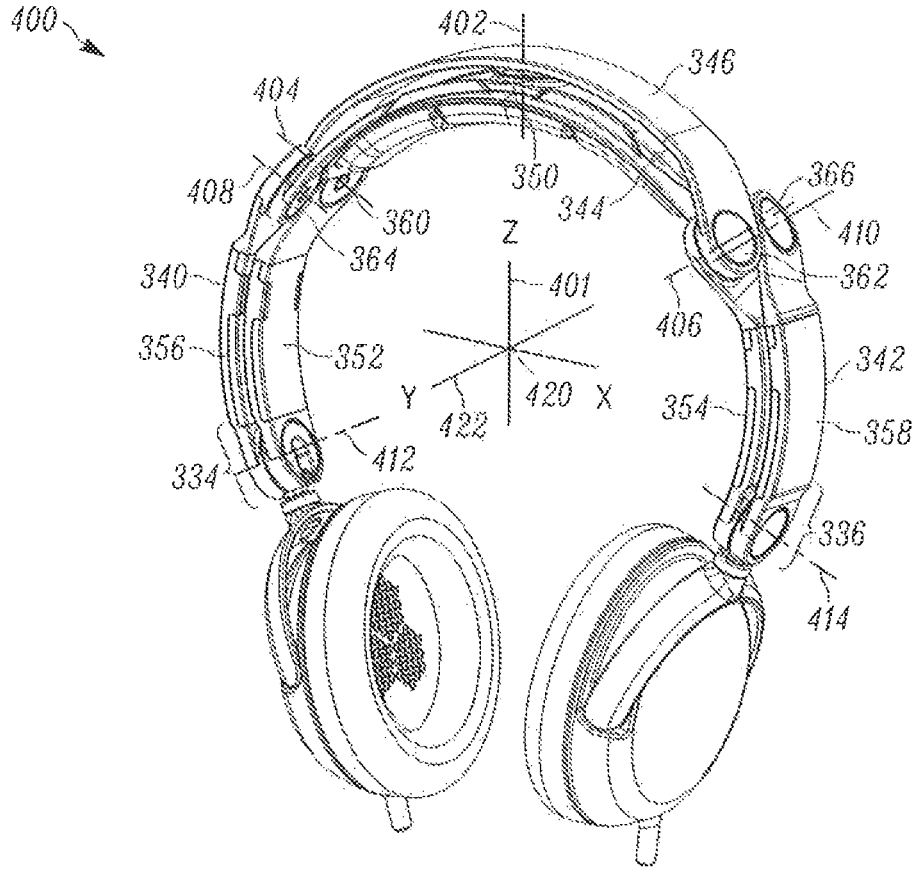
FIG. 4 illustrates the various axes of rotation of an embodiment of length-adjustable collapsing headphones according to the present teaching.

The keyhole pivot assembly 334, 336 is described in more detail in connection with FIGS. 6A-B. Briefly, the keyhole pivot assembly is essentially a shaft or fastener with a centerline or axis that is in-line with the theoretical centerpoint 402 (FIG. 4). The keyhole pivot assembly 334, 336 perform multiple functions, such as connecting the arms, creating the axis to the centerpoint, allows the arms to freely rotate when "unlocked", allows the elements to lock together, and also centers the earcups during the collapse sequence.

In some embodiments of the headphone apparatus, there is no specific "roll" adjustment axis. Fit in the x-axis (provided by the roll adjustment axis) is typically addressed by the uniform circular earcup shape and/or a pre-tilted non-circular shape that mimics an average ear shape.

The headband 306 has an upper section 338, a right lower section 340 and a left lower section 342. The upper section 338 includes two arms, and inner headband arm 344, and an outer headband arm 346. The upper section 338 also includes a cushion 348 that is positioned under the inner headband arm 344. In some embodiments, the cushion 348 is removable, and can include a mechanism to snap onto the inner headband arm 344. In other embodiments, the cushion 348 is permanently attached to the inner headband arm 344.

In some embodiments the cushion 348 comprises a cushion sub-assembly. The cushion sub-assembly contains additional parts comprising a pad, made of a soft material mounted to a rigid pad base. This cushion sub-assembly is attached by way of four hook snap features on the pad base that lock and correspond to recess features on the top side of the inner headband arm making the cushion sub-assembly removable.

The outer headband arm 346 is connected to the inner headband arm 344 using a pivot joint 350. The pivot joint 350 is centrally located at the top central position of the headband 306, and allows the outer headband arm 346 and the inner headband arm 344 to rotate freely around the pivot joint 350. In some embodiments, inner headband arm 344 and outer headband arm 346 are joined at pivot joint 350 by way of a snap feature or fastener.

The right lower section 340 and a left lower section 342 of the headband 306 include a scissor arm assembly. Each scissor arm assembly includes an inner scissor arm 352, 354 and an outer scissor arm 356, 358. The inner scissor arm 352, 354 and the outer scissor arm 356, 358 each include slide adjustment sub-assemblies that are describe in more detail in the description related to FIGS. 7A-B. Arm pivots 360, 362, 364, 366 are used to connect the upper section 338 to the lower sections 340, 342. Arm pivots 360, 362 connect the outer headband arm 346 to the inner scissor arms 352, 354 and the arm pivots 364, 366 connect the inner headband arm 344 to the outer scissor arms 356, 358. The lower sections 340, 342 connect to the earcup assemblies 308, 310 using the keyhole pivot assemblies 334, 336.

Thus, the headband 306 comprises six arms, inner headband arm 344, outer headband arm 346, the two inner scissor arms, right inner scissor arm 352 and left inner scissor arm 354, and the two outer scissor arms, right outer scissor arm 356 and left outer scissor arm 358, so as to form a scissor arm linkage assembly by being joined at their ends in a particular arrangement using pivot joints.

In some embodiments, the mechanical features and hard parts of the headphones, like the headband arms, pivots, yokes and earcups, are made of injection molded plastic. Some of the less feature-rich components could be made from cast alloys, or sheet metal. The cushion components can be made from urethane-based foam, skinned with a leather or leatherette fabric. In other embodiments, the main arm parts may be manufactured out of metal either by casting, machining or stamping or any combination thereof. The main arm parts may also be made out of wood potentially with more rigid metal or plastic insets for the joints.

One feature of the present teaching is that the headband arms are arranged in a collapsing spherical linkage assembly that allows the headphone to be folded into a compact package. FIG. 4 illustrates the various axes of rotation of an embodiment of a length-adjustable collapsing headphone 400 of the present teaching. The length-adjustable collapsing headphone 400 of the present teaching contains a total of six linkage arms that were described in connection with FIG. 3. One pair of linkage arms, inner headband arm 344, and outer headband arm 346 is centrally oriented on the z axis 401. Two other pairs of linkage arms, right inner scissor arm 352 and right outer scissor arm 356 and left inner scissor arm 354 and left outer scissor arm 358, are identical and rotationally symmetric around the y axis 422. These various arms 344, 346, 352, 354, 356, 358 are joined at the ends respectively via the arm pivots 350, 360, 362, 364, 366 and keyhole pivot assemblies 334, 336 to form a linkage arrangement that is described further below.

The arm pivots 360, 362, 364, 366, which comprise the respective ends of the arms, inner scissor arms 352, 354, and outer scissor arms 356, 358, are shifted spherically and offset positively and negatively at a given angle to form axes 404, 406, 408, 410 that maintain a common center point of the origin 420. Similarly, the arm pivots 360, 362, 364, 366 in keyhole pivot assemblies 334, 336 that connect the inner scissor arms 352, 354 to respective outer scissor arms 356, 358 comprise axes 412, 414 that maintain a common center point of the origin 420. Axes of keyhole pivot assemblies 336, 334 are aligned with the central headband pivot axis 402 and maintain a common centerpoint at the origin 420. As a result the headphones collapse in an arc, inwards to the central headband pivot axis 402 along the FIG. 2 Y axis 214 (pitch) only. In general, all the pivot axes are aligned to the center point 420 and always maintain alignment to the center point 420 throughout the collapse sequence.

Thus, the axes of all pivots, including the arm pivots 360, 362, 364, 366, the pivots in keyhole pivot assemblies, 334, 336 and the pivot joint 350, all share a common origin point that is the intersection of the projected axes 402, 404, 406,408,410, 412, 414 of all pivots. This feature allows the travel of all six of the arms 344, 346, 352, 354, 356, 358 and the corresponding pivots, arm pivots 360, 362, 364, 366, pivots in keyhole pivot assemblies, 334, 336 and pivot joint 350, to travel in a spherical, synchronized and/or simultaneous path or motion while maintaining their perpendicular orientation towards the origin 420.

The arms 352, 354, 356, 358 of the two lower sections 340, 342 include a length adjustment mechanism, which is described in more detail below. In one embodiment, the length adjustment mechanism is rotationally oriented around the y axis 422 in the normal resting state of the mechanism in order to allow the free rotation and length adjustment of the lower sections 340, 342 in the prescribed path. This functionality may be integrated into different sections of a headphone design and may fall in the top arms, in the yoke or in the ear cup region.

In some embodiments, the arm pivots and the pivot joint contain a detent feature within the interior of the pivot on the mated faces that corresponds to the open and closed angles and stops the over rotation of the pivots themselves in the open position. For example, referring to FIG. 3, joints 362 or 366, could be placed on the inside of the joint on the bearing surfaces. In some embodiments, instead of having a flat face-to-face contact, the joints are comprised of an interlocking surface, which may be triangular, but could also be as simple as a step. This eases the strain on the hardware or connecting feature increasing the strength of the joint.

Figure 5A:
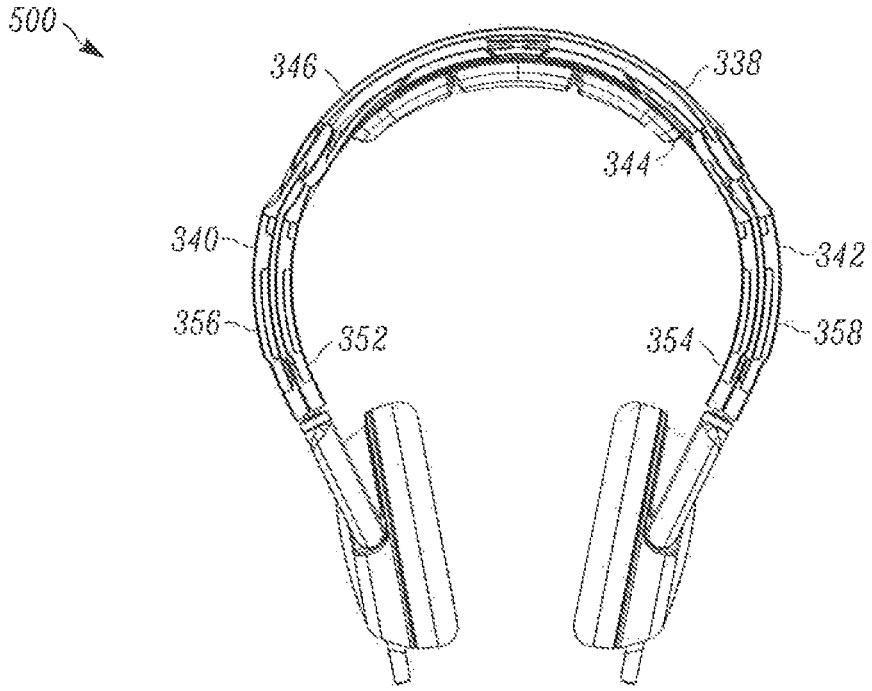
FIG. 5A illustrates a front-view of an embodiment of length-adjustable collapsing headphones according to the present teaching.

FIG. 5A illustrates a front view 500 of an embodiment of a length-adjustable collapsing headphone of the present teaching. The front view 500 illustrates how the upper headband section 338 and lower headband sections 340, 342 are arranged to conform to a spherical surface centered at an origin. Also, illustrated is how the inner scissor arms 352, 354 and the inner headband arm 344 are positioned on an inner sphere and the outer scissor arms 356, 358 and outer headband arm 346 are positioned on an outer sphere wherein the inner and outer sphere comprise the same center.

Figure 5B:
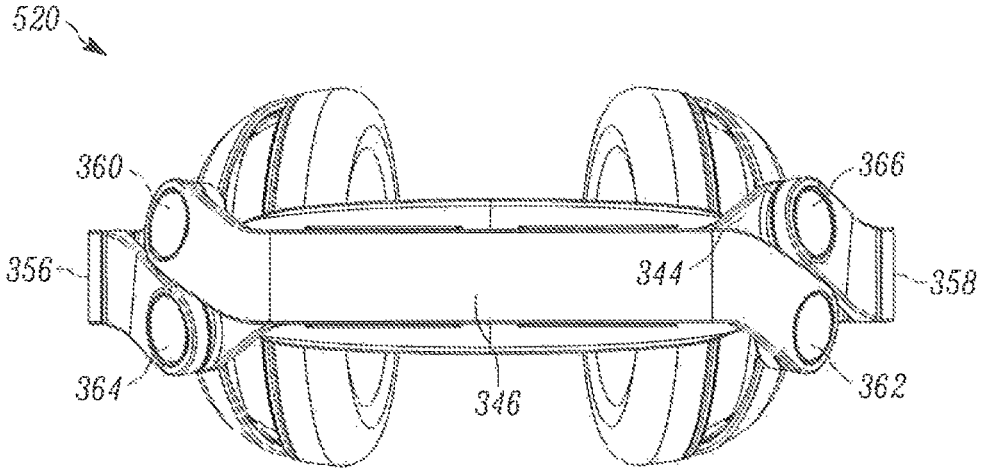
FIG. 5B illustrates a top-view of the length-adjustable collapsing headphones of FIG. 5A.

FIG. 5B illustrates a top-view 520 of the length-adjustable collapsing headphone of FIG. 5A. The top-view illustrates how the arm pivots 360, 362 connect the outer headband arm 346 to the inner scissor arms (not visible in the perspective of FIG. 5B). The top-view also illustrates how the arm pivots 364, 366 connect the inner headband arm 344 to the outer scissor arms 356, 358.

Figure 5C:
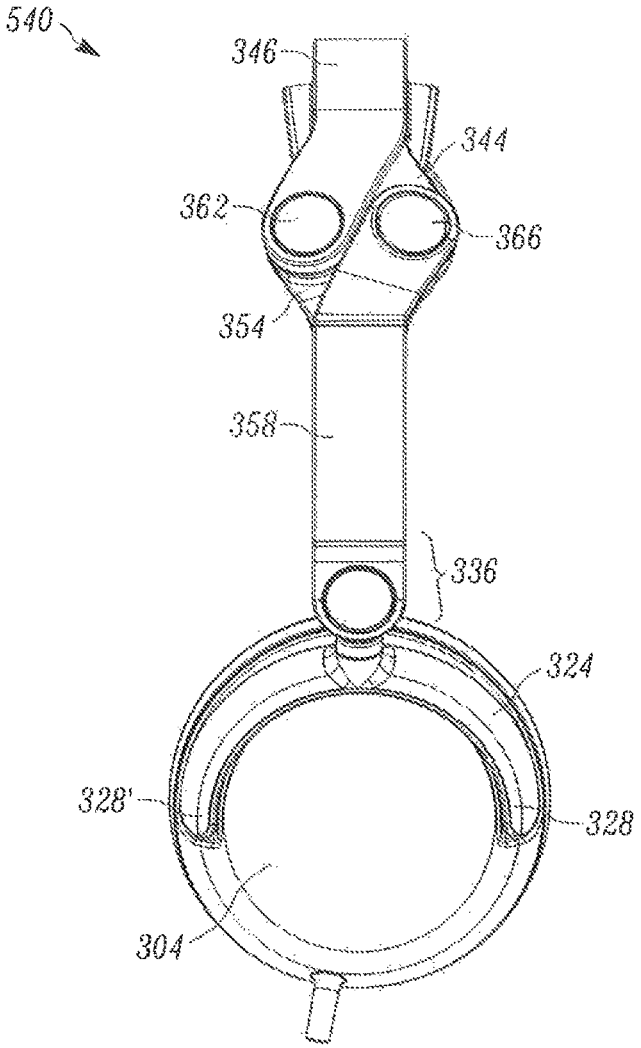

FIG. 5C illustrates a right-side view 540 of the length-adjustable collapsing headphone of FIG. 5A. The right-side view illustrates the arm pivots 362, 366 that connect the outer headband arm 346 to the inner scissor arm 354 and the inner headband arm 344 to the outer scissor arm 358. FIG. 5C also illustrates the lower section 342 (FIG. 5A) connected to the yoke 324 using keyhole pivot assembly 336. FIG. 5C also illustrates the yoke 324 connected to earcup 304 using an axel 328, 328'.

Figure 6A:
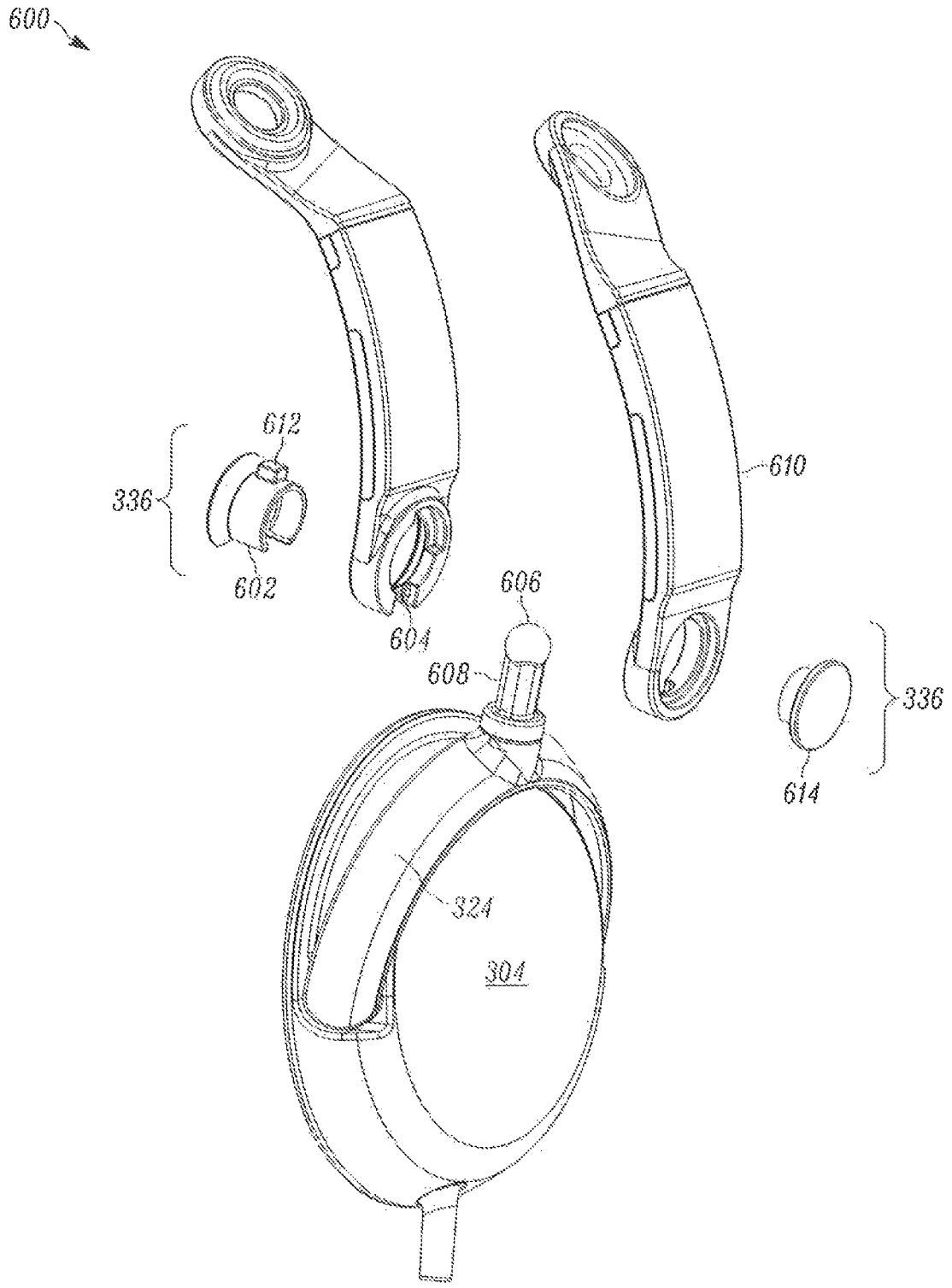
FIG. 6A illustrates an exploded side-view of the lower section of length-adjustable collapsing headphones of the present teaching.

FIG. 6A illustrates an exploded side-view 600 of the lower section 342 of a length-adjustable collapsing headphone according to the present teaching. The lower joint comprises a keyhole pivot assembly 336 that contains a locking and radial pivot mechanism which centers the earcup 304 in the closed state by way of a free rotating hub 602 with a keyhole 604 feature that is closed off against a corresponding face of the recess, which is contained internally within the keyhole pivot itself. The faces are arranged radially with a corresponding angle to that of the maximum closed angle of the arms in the collapsed state to allow the free rotating axel to spin freely while in an interim state, between open and closed or collapsed. The keyhole pivot assembly 336 includes a rotating hub 602 and end cap 614 that secure a ball 606 and ball end shaft 608. The features on the inside of the lower pivots when mounted together create the centering mechanism. The locking of the collapse sequence is accomplished when the ball end shaft 608 is pressed into the slot, which is formed by rotating hub 602 and keyhole 604, and end of the outside lower arm 610. Keyhole 604 forms a lockout slot. The key feature is the small tab 612 that sits atop the rotating hub 602. There are essentially two functions accomplished in the joint: 1) the locking of the collapsing sequence; and 2) the centering of the earcup during the collapse sequence.

The upper end of the headphone yoke 324 (FIG. 3) is centrally located and oriented vertically, parallel to the normal face plane of the earcup 304. The upper end of the headphone yoke 324 includes a post with a ball end 606 and shaft 608. This feature is referred to as the ball pin. This ball pin structure allows for free rotation as a ball and socket joint when the ball pin shaft 608 is disengaged from the keyhole 604. Thus, the keyhole 604 forms the slot and space created inside the joint and controls the centering. Conversely, when the ball pin shaft 608 is locked in the keyhole 604, rotation of the yoke is halted.

In some embodiments, the interior of the keyhole pivot assembly contains a corresponding set of beveled surfaces, so that when the arms are spread to begin the collapsing sequence, the ball pin shaft 608 is forced out of the keyhole 604 and thus unlocks the keyhole pivot assembly 336 automatically. These beveled surfaces would be on the inside vertical faces of the slot on keyhole 604 and bevel outwards to force the ball pin shaft out when the collapse sequence is initiated, instead of having a separate step to unlock the ball pin shaft from the arm ends. This feature also serves as a breakage mitigation feature.

In the down position, the ball pin shaft 608 locks into the keyhole pivot assembly hub and the corresponding channels at the end of the arms. The down position effectively halts any rotation or separation of the arms and thus preventing the collapse sequence to proceed. This keyhole pivot assembly hub comprises rotating hub 602 and the end cap fastener. The ball pin shaft 608 also locks in to the arm ends as well because they are slotted, similarly to rotating hub 602 and the end cap fastener.

Figure 6B:
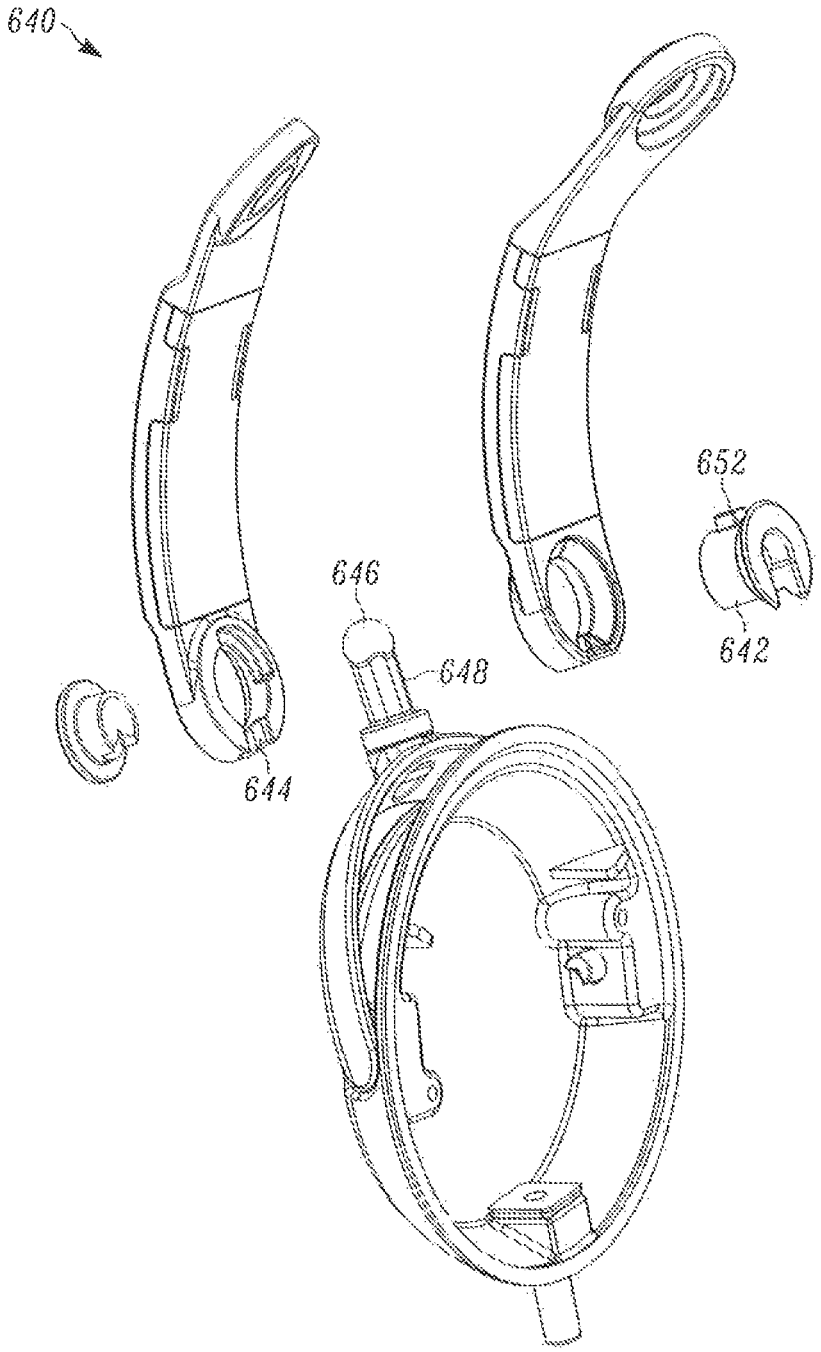
FIG. 6B illustrates a rotated exploded side-view of the lower section of length-adjustable collapsing headphones of FIG. 6A.

FIG. 6B illustrates a rotated exploded side-view 640 of the lower section of a length-adjustable collapsing headphone of FIG. 6A. This figure illustrates the lower joint with keyhole pivot assembly, including rotating hub 642 with a keyhole 644 with tab 652, recess features, and yoke with ball pin shaft 648 and ball 646.

Figure 7A:
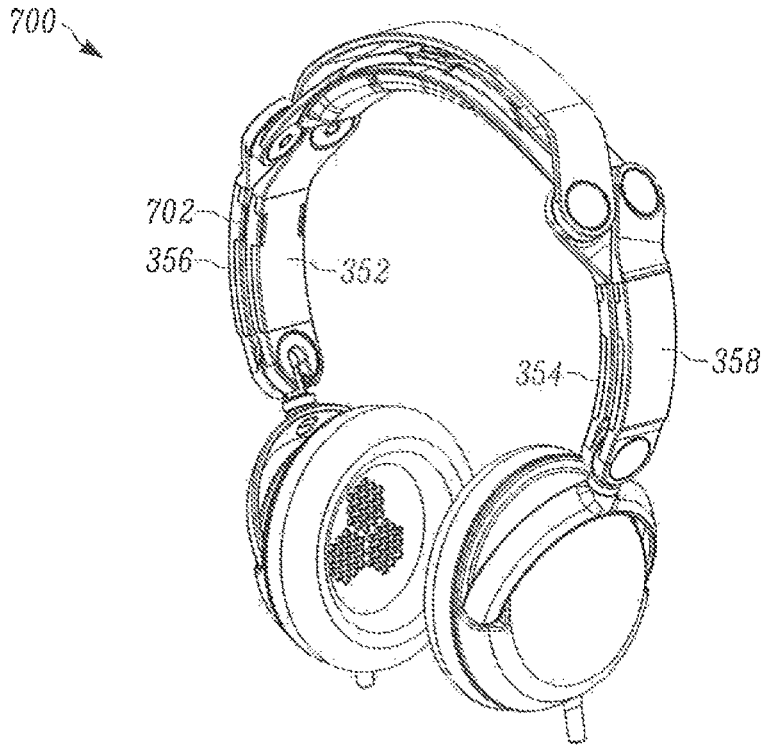
FIG. 7A illustrates an embodiment of the length-adjustable collapsing headphones of the present teaching with the arms contracted.
Figure 7B:
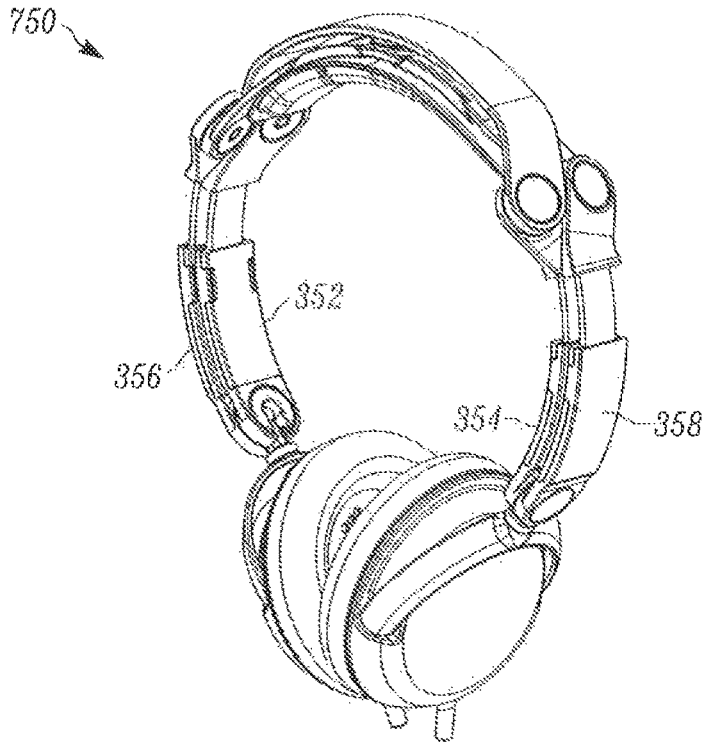
FIG. 7B illustrates an embodiment of the length-adjustable collapsing headphones of the present teaching with the arms extended.

FIG. 7A and FIG. 7B illustrate the arm extension feature of the length-adjustable collapsing headphone of the present teaching. FIG. 7A illustrates an embodiment of the length-adjustable collapsing headphone of the present teaching with the arms contracted. FIG. 7B illustrates an embodiment of the length-adjustable collapsing headphone of the present teaching with the arms extended.

Referring to both FIGS. 7A and 7B, a snap mechanism 702 is included within inner scissor arms 352, 354 and within outer scissor arms 356, 358. The snap mechanism 702 includes a ratchet mechanism and a latch mechanism positioned on the end of the trapped arm that is rotationally oriented around the z axis in the normal resting state of the mechanism and allows the free rotation and length adjustment of the arms in the prescribed path. The snap feature is essentially a closure mechanism and only holds the two separate parts that make up the lower sections together. The ends of the upper parts of the lower arms contain a hook feature that allows the arms to move respective of each other but not separate, essentially trapping it in between two lower parts. Also, included internally within the subassembly on the upper part is a living hinge or spring loaded detent that corresponds to a track or rack of softened clip like features and allows the arms to adjust incrementally against each other. This can be thought of as a radial ratchet type mechanism. In other words, a linear ratchet mechanism that follows a radial path.

Figure 8A:
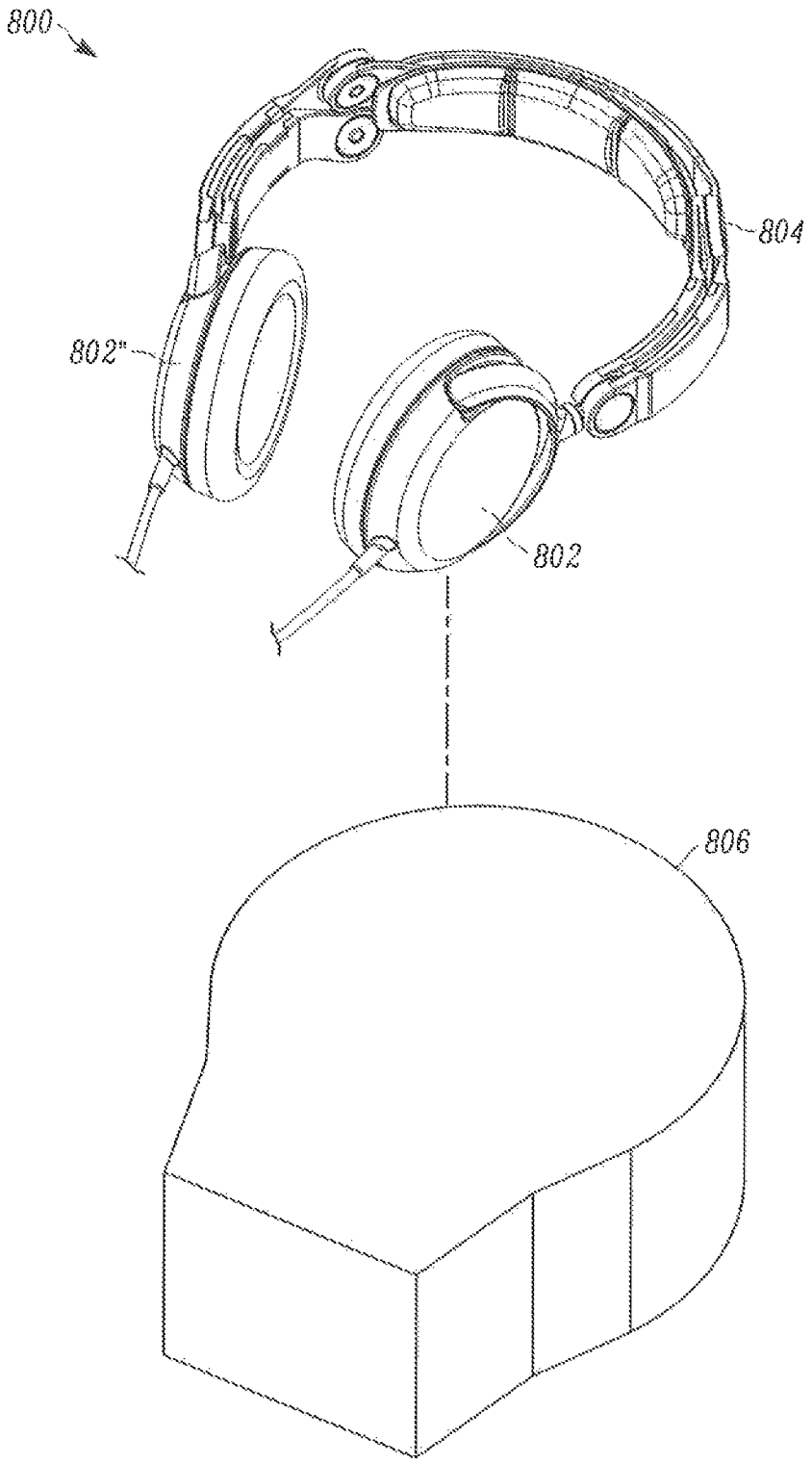
FIG. 8A illustrates an embodiment of a pair of length-adjustable collapsing headphones of the present teaching showing the headphone size in an open state according to the present teaching.
Figure 8B:
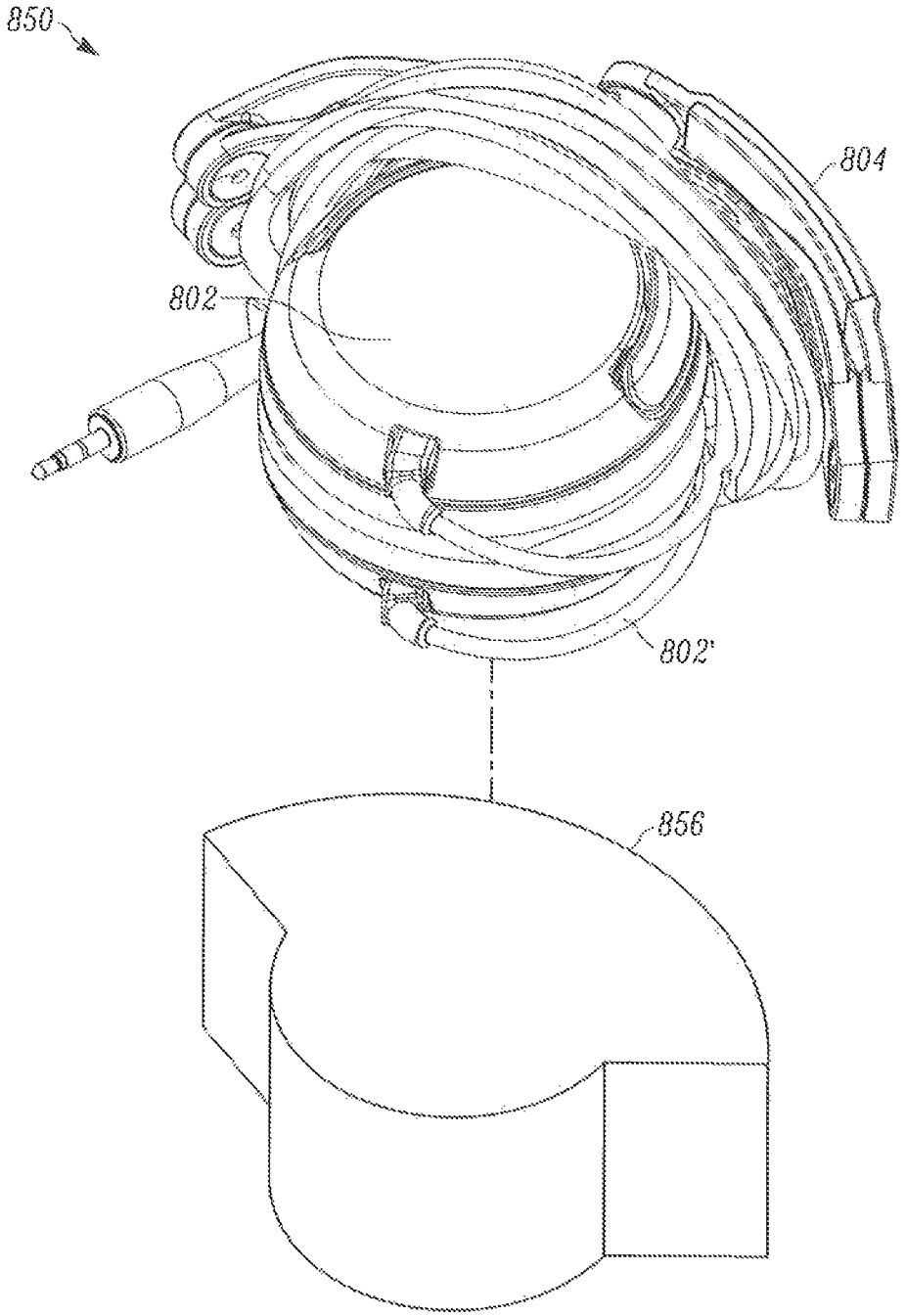
FIG. 8B illustrates an approximate volume of an embodiment of a pair of length-adjustable collapsing headphones in a closed state according to the present teaching.

FIGS. 8A and 8B illustrate a volume (not to scale) of the length-adjustable collapsing headphone according the present teaching in the open and closed states. FIG. 8A illustrates an embodiment of a length-adjustable collapsing headphone in an open state 800 of the present teaching. In an open state 800, the headphones can be secured on a human head with the earcups 802, 802' positioned over the ears and the headband 804 situated over the top of the head. FIG. 8A illustrates a three-dimensional geometry 806 representing the approximate volume of the headphones in an open state (not to scale), with the length-adjustable elements retracted.

In some embodiments, the volume of space occupied by the three-dimensional geometry is about 1616 $cm^3$ FIG. 8B illustrates a volume of an embodiment of a length-adjustable collapsing headphone in a closed state 850 according to the present teaching. In a closed state 850, the headphones are collapsed using the scissor arm feature of the present teaching to provide a compact space-efficient arrangement for portability and storage. In the closed state 850, the earcups 802, 802" are positioned under the collapsed headband 804 and opposing pivots can come into contact with each other. A three-dimensional geometry 856 representing the approximate volume (not to scale) of the headphones in a closed state, with the length-adjustable elements retracted, is illustrated. In some embodiments, the volume of the three dimensional geometry is about 495 $cm^3$. Thus, the closed-state is space efficient and has a volume that is substantially less than the open-state volume. Some embodiments of the present teaching result in a ratio of the closed-state volume to the open-state volume that is less than 31%.

Figure 9A:
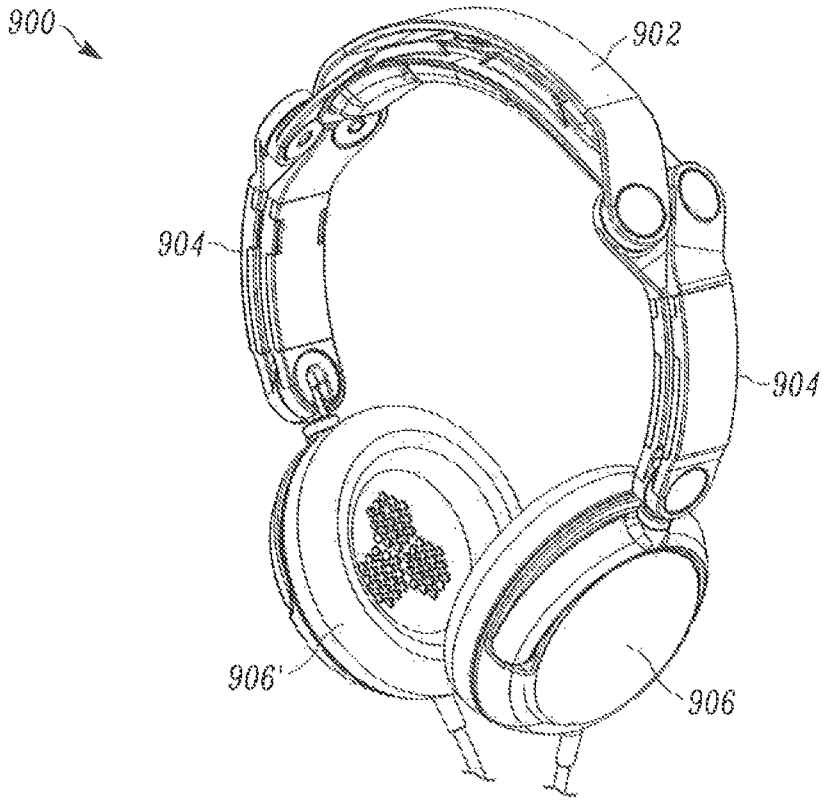
FIG. 9A illustrates a first step an embodiment of a collapsing sequence of the length-adjustable collapsing headphones of the present teaching.

FIGS. 9A-G illustrate an embodiment of a collapsing sequence of the length-adjustable collapsing headphones of the present teaching. FIG. 9A illustrates the first step 900 of a collapsing sequence of the length-adjustable collapsing headphones of the present teaching. The headphones 902 are in an open state, with the length-adjustable arms in the lower section 904 retracted.

Figure 9B:
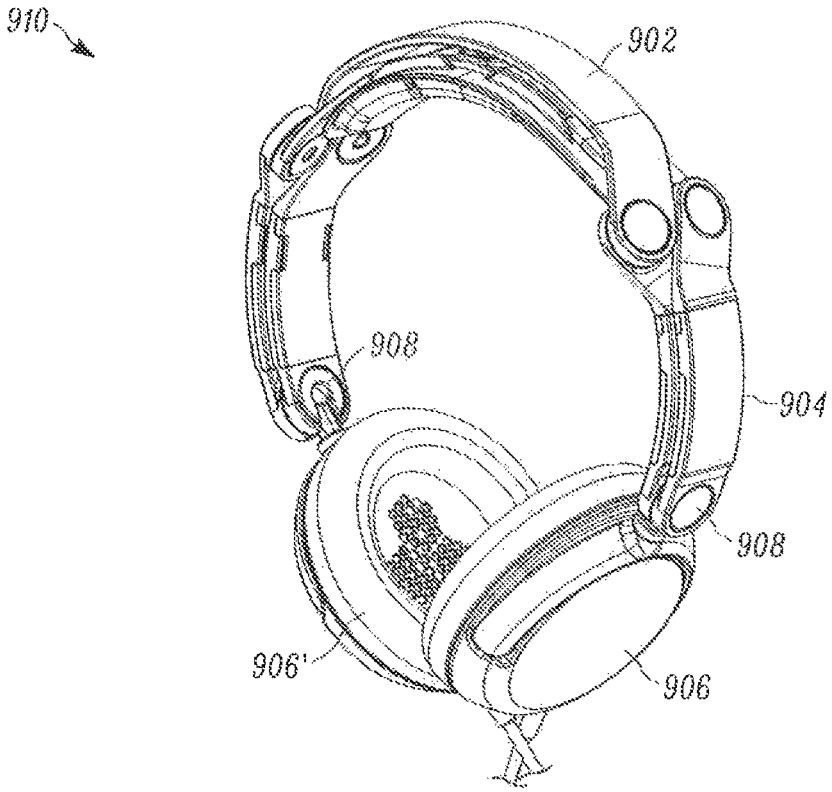
FIG. 9B illustrates a second step an embodiment of a collapsing sequence of the length-adjustable collapsing headphones of the present teaching.

FIG. 9B illustrates the second step 910 of the collapsing sequence of the length-adjustable collapsing headphones of the present teaching. The collapsing sequence is initiated by pushing the earcups 906, 906' inward and thus unlocking the keyhole pivot assembly 908, allowing the scissor arm linkage to move freely.

Figure 9C:
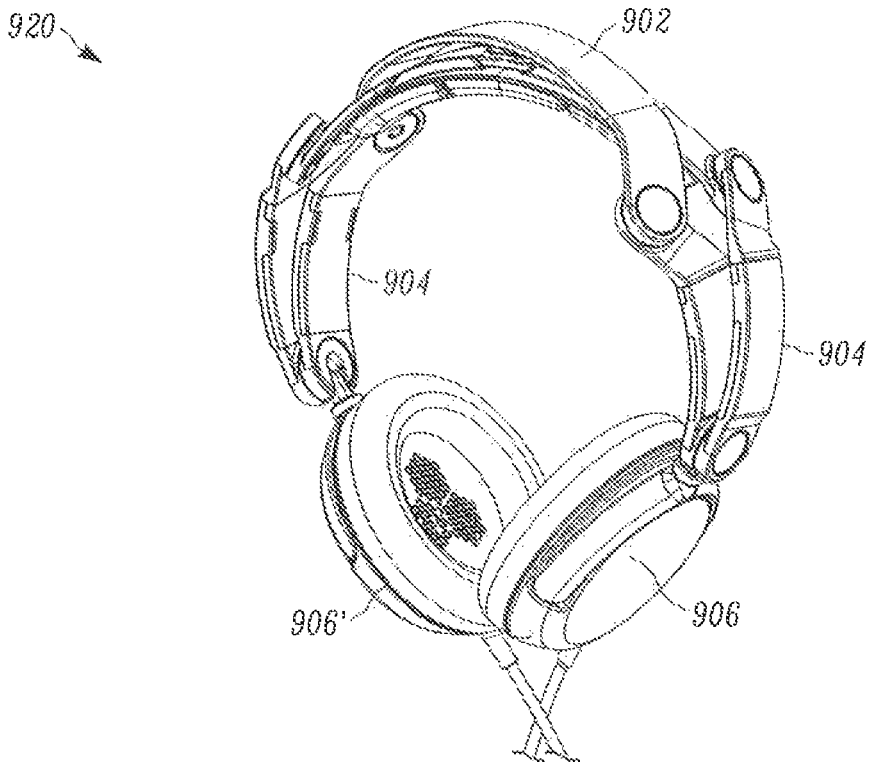
FIG. 9C illustrates a third step an embodiment of a collapsing sequence of the length-adjustable collapsing headphones according to the present teaching.

FIG. 9C illustrates the third step 920 of the collapsing sequence of the length-adjustable collapsing headphones of the present teaching. In the third step 920, the user initiates a rotational motion to split the arms of the lower section 904 away from each other. This causes the simultaneous motion of all arms relative to each other and allows them to follow a spherical path due to the geometry built in to the arms themselves.

Figure 9D:
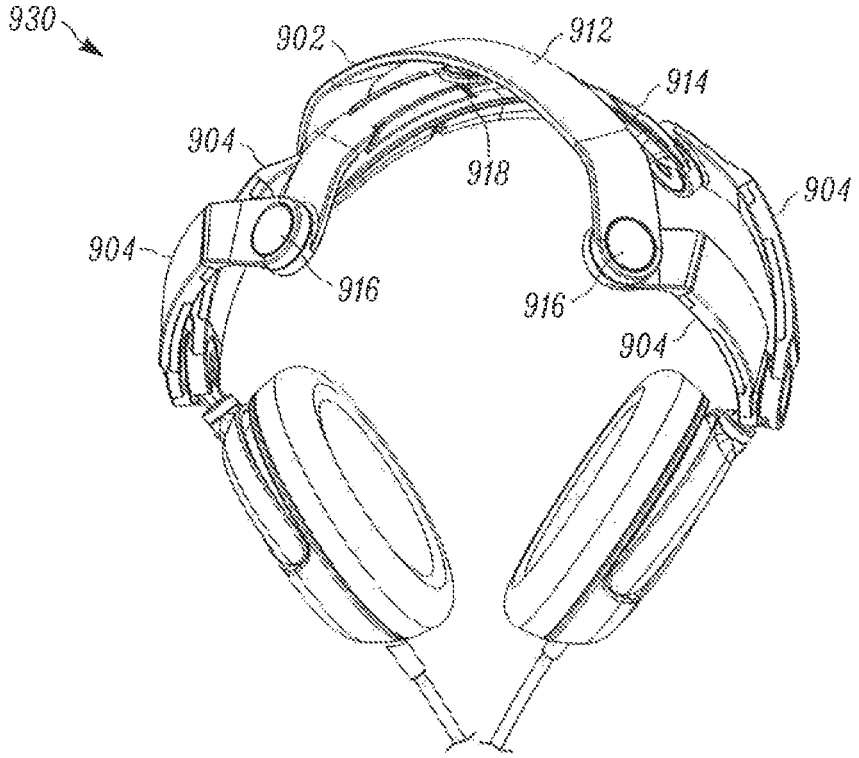
FIG. 9D illustrates a fourth step of an embodiment of a collapsing sequence of the length-adjustable collapsing headphones according to the present teaching.

FIG. 9D illustrates the fourth step 930 of the collapsing sequence of the length-adjustable collapsing headphones of the present teaching. In the fourth step 930, the arms of the lower section 904 and the outer headband arm 912 and an inner headband arm 914 progress along a spherical path. The arms of the lower section 904 and the inner and outer headband arms 912, 914 are guided in the motion via a rotation around arm pivots 916. The outer headband arm 912 and an inner headband arm 914 are guided in their motion by rotation around the upper arm pivot 918. At this point in the collapse sequence 900, the outer headband arm 912 and an inner headband arm 914 are oriented approximately orthogonal to each other.

Figure 9E:
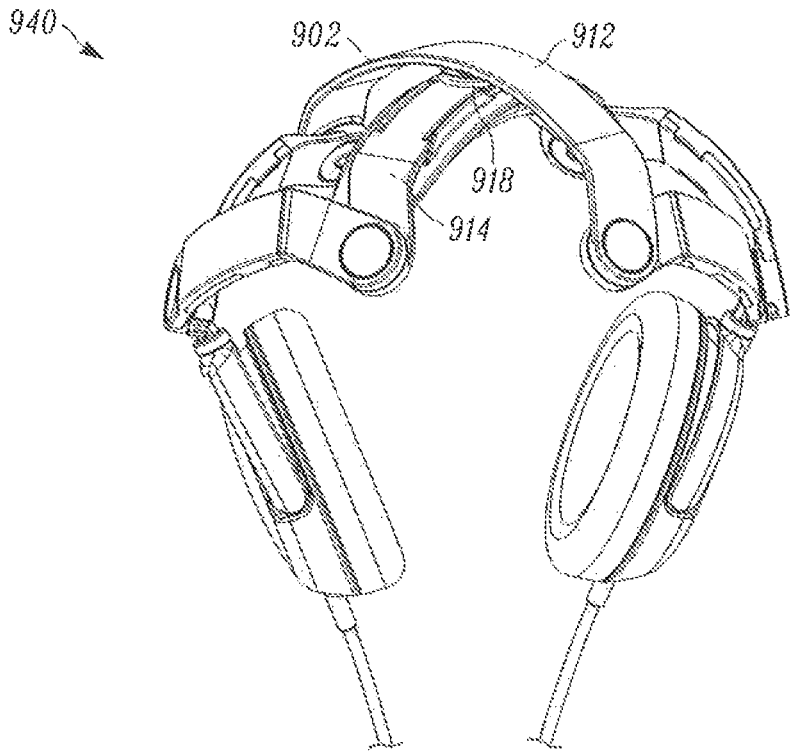
FIG. 9E illustrates a fifth step of an embodiment of a collapsing sequence of the length-adjustable collapsing headphones according to the present teaching.

The FIG. 9E illustrates the fifth step 940 of the sequence of the length-adjustable collapsing headphones of the present teaching. At this point in the collapse sequence 900, the outer headband arm 912 and the inner headband arm 914 have been rotated beyond the orthogonal position, continuing the direction of rotation around the upper arm pivot 918.

Figure 9F:
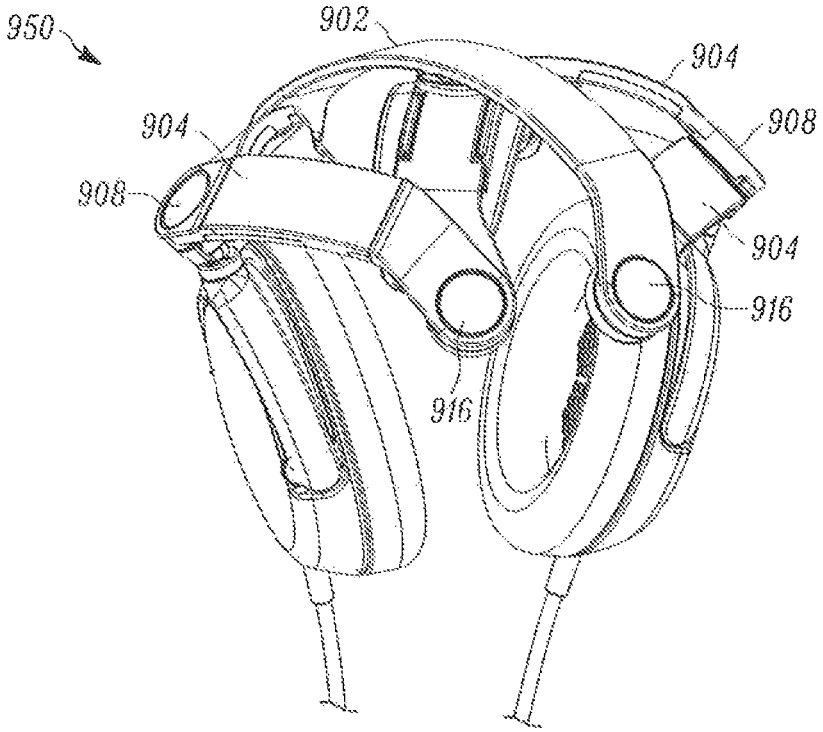
FIG. 9F illustrates a sixth step of an embodiment of a collapsing sequence of the length-adjustable collapsing headphones according to the present teaching.

FIG. 9F illustrates the sixth step 950 of the collapsing sequence of the length-adjustable collapsing headphones 902 of the present teaching. At this point, in the collapse sequence 900, the outer headband arm 912 (FIG. 9E) and the inner headband arm 914 have made further progress on the continuing the direction of rotation around the upper arm pivot 918 (FIG. 9E). The arms of the lower section 904 continue further along the spherical path guided by continued rotation around arm pivots 916 and keyhole pivot assemblies 908.

Figure 9G:
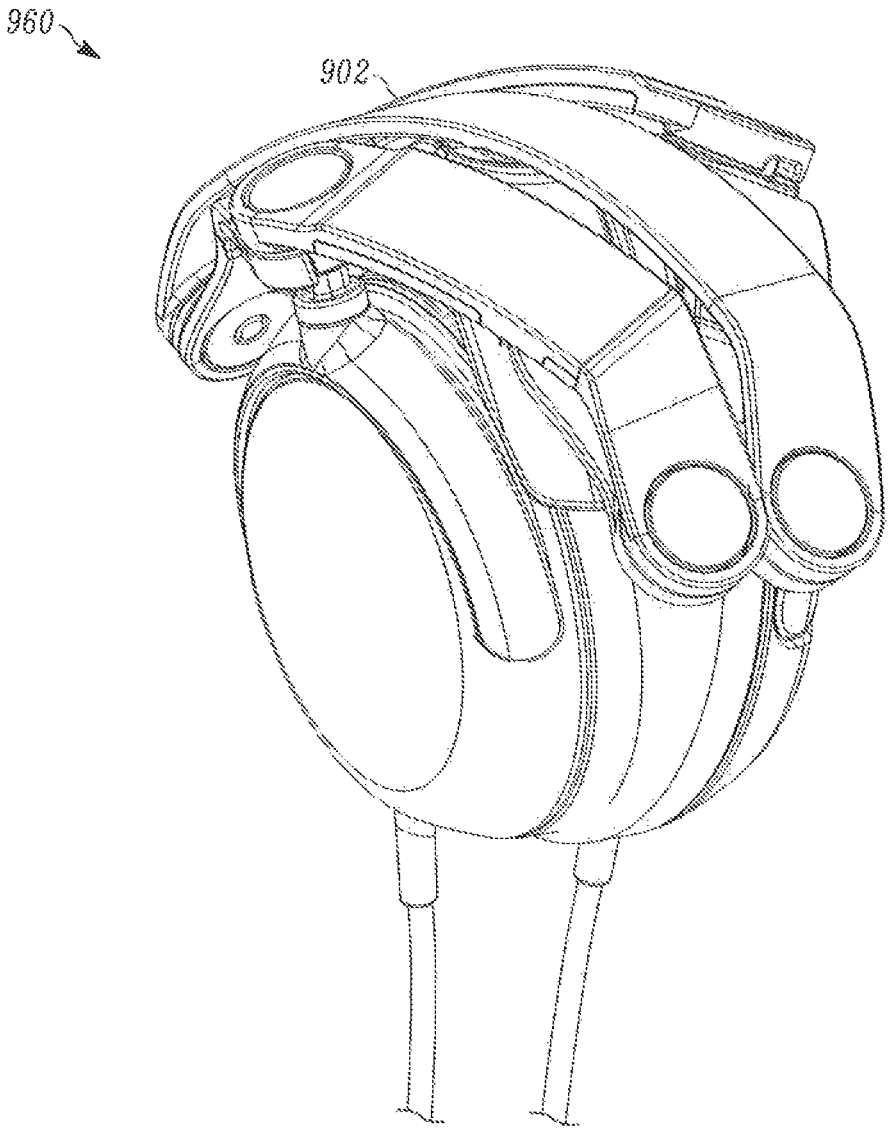
FIG. 9G illustrates a seventh step of an embodiment of a collapsing sequence of the length-adjustable collapsing headphones according to the present teaching.

FIG. 9G illustrates the seventh step 960 of the collapsing sequence of the length-adjustable collapsing headphones of the present teaching. By rotating the arms of the lower section 904 (FIG. 9F) to their farthest most position, they will come into contact with the outer headband arm 912 (FIG. 9E) and the inner headband arm 914 (FIG. 9E), thus ending the collapse sequence. In this position, the arms become nested to each other, achieving a minimum overall volume of the entire unit.

Referring back to FIGS. 4 and 6A-B, the keyhole pivot assembly 334, 336, built in to the lower end of the scissor arms of the lower sections 340, 342 includes a rotating shaft 608 and ball 608 joint assembly. The earcups 302, 304 are held in this keyhole pivot with a ball pin. This keyhole pivot is controlled by way of corresponding recesses in each of the ends of the arms of the lower sections 340, 342. These recesses control the position of the keyhole pivot and thus the position of the earcups 302, 304 relative to the arms themselves.

In the seventh step 960 of the collapsing sequence, in which the headphones 902 are in the closed state, the earcups 302, 304 are allowed to come together and mate face-to-face (parallel to each other), or equivalently, ear pad-to-ear pad, in the center of the unit. For embodiments in which the headphones include cords, the collapsed unit creates a bollard type shape to wrap the cord around further securing the closed unit (see, for example, the embodiment illustrated in FIG. 8B).

To open the headband, the sequence is reversed, with the final step of pushing the earcups outward to lock the headband and scissor arm assemblies of the lower section in place, as illustrated in the starting point of the sequence, step one 900.

It should be understood that the embodiment shown in connection with illustration of FIGS. 9A-9G is just one example of the present teaching. One skilled in the art will appreciate that there are numerous other configurations according to the present teaching. To illustrate this point, FIGS. 10A-10D are presented to illustrate views of a simplified length-adjustable collapsing headphones that uses only four arms.

Figure 10A:
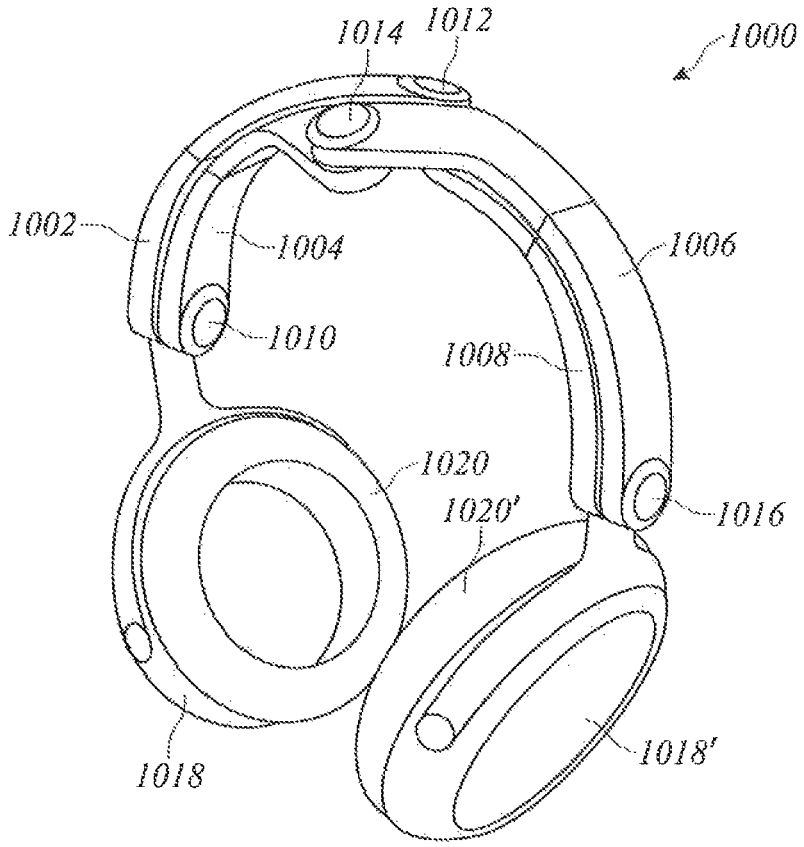
FIG. 10A illustrates an embodiment of a simplified length-adjustable collapsing headphones according to the present teaching.

FIG. 10A illustrates an embodiment of a simplified length-adjustable collapsing headphones 1000 according to the present teaching. This embodiment of the length-adjustable collapsing headphones 1000 is a collapsing head band comprising only four arms, 1002, 1004, 1006, and 1008 that are coupled at four pivot points 1010, 1012, 1014, 1016. The arms 1002 and 1006 are outer arms, while the arms 1004 and 1008 are inner arms. Earcups 1018, 1018' and earpads 1020, 1020' as described herein are also included. The simplified length-adjustable collapsing headphones 1000 is similar to the length-adjustable collapsing headphones described in connection with FIGS. 3-9 in that the pivot points 1010, 1012, 1014, 1016 are arranged to allow the arms to collapse or rotate to reduce the physical size of the headphone.

Figure 10B:
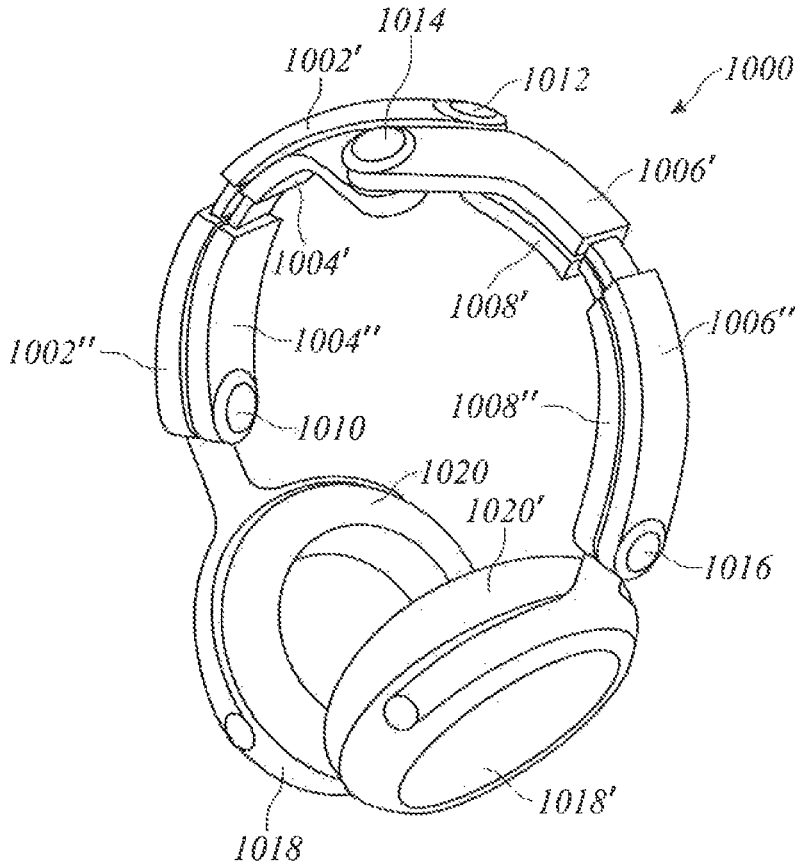
FIG. 10B illustrates the simplified length-adjustable collapsing headphones showing the outer arms and the inner arms extending to initiate a collapsing sequence.

FIG. 10B illustrates the simplified length-adjustable collapsing headphones 1000 showing the outer arms 1002, 1006 and the inner arms 1004, 1008 extending to initiate a collapsing sequence. Referring to both FIGS. 10A and 10B, the four pivot points 1010, 1012, 1014, 1016 allow the outer arms 1002, 1006 and the inner arms 1004, 1008 to begin moving into the partially collapse position. This view of the simplified length-adjustable collapsing headphones 1000 shows the length adjusting feature of the outer arms 1002, 1006 and the inner arms 1004, 1008 that separates each of the arms into two sections, outer arm sections 1002, 1002', 1006, 1006' and the inner arm sections 1004, 1004', 1008, 1008' as shown in FIG. 10B.

Figure 10C:
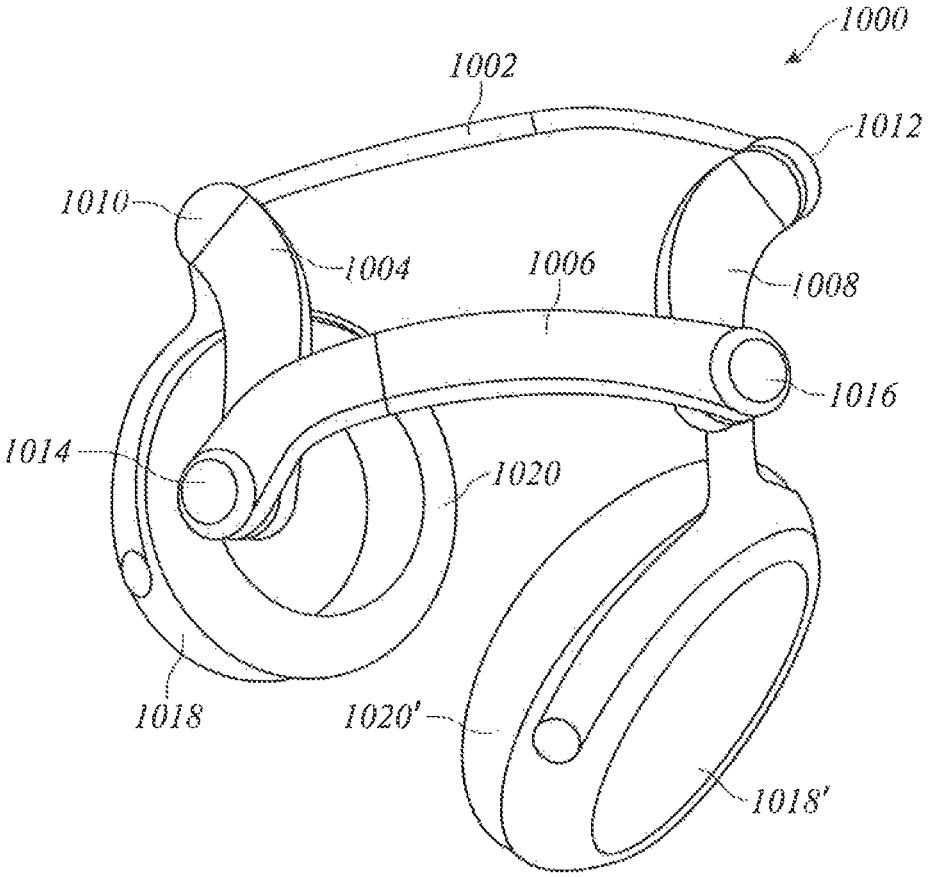
FIG. 10C illustrates the simplified length-adjustable collapsing headphones showing the outer arms and the inner arms extending further in the collapsing sequence

FIG. 10C illustrates the simplified length-adjustable collapsing headphones 1000 showing the outer arms 1002, 1006 and the inner arms 1004, 1008 extending further in the collapsing sequence. Referring to both FIGS. 10A and 10B, the four pivot points 1010, 1012, 1014, 1016 allow the outer arms 1002, 1006 and the inner arms 1004, 1008 to move further into collapse sequence with the outer arms 1002, 1006 and the inner arms 1004, 1008 now in a position to collapse the headphones 1000.

Figure 10D:
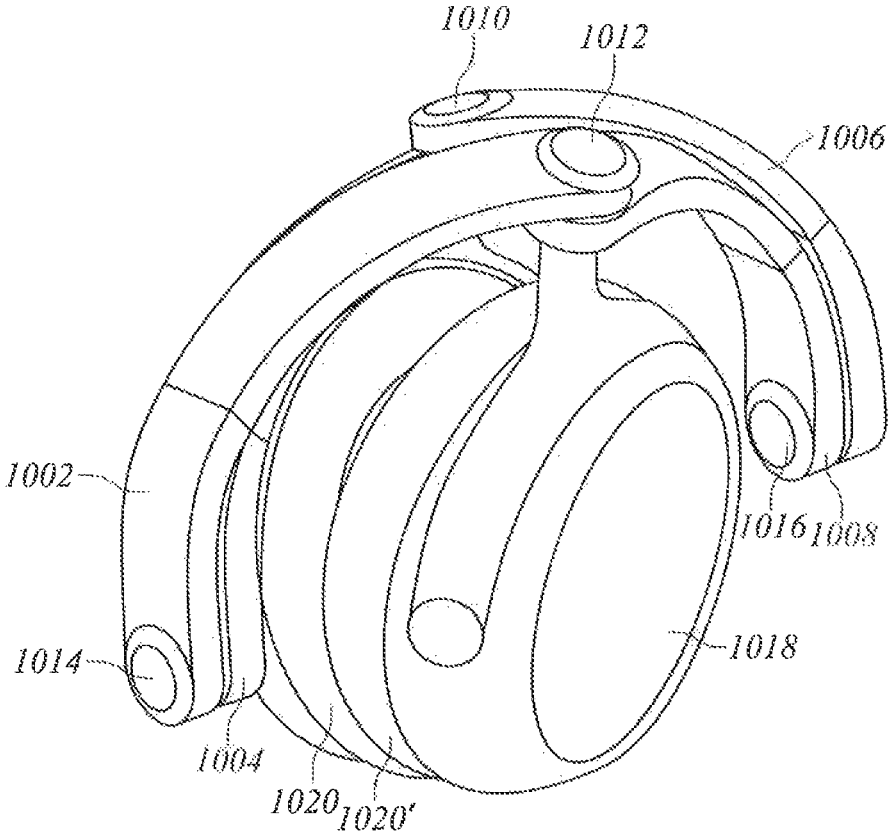
FIG. 10D illustrates the simplified length-adjustable collapsing headphones showing the outer arms 1002, 1006 and the inner arms 1004, 1008 in the fully collapsed position.

FIG. 10D illustrates the simplified length-adjustable collapsing headphones 1000 showing the outer arms 1002, 1006 and the inner arms 1004, 1008 in the fully collapsed position. In this simplified length-adjustable collapsing headphone configuration there is no significant reduction in the overall arc length of the headband itself in the fully open and fully collapsed configuration. However, this configuration allows the earcups 1018, 1018' to become oriented face-to-face (parallel to each other) in the collapsed position. The headphone configuration in the collapsed states is significantly more compact as the earcups 1018, 1018' are parallel to each other and to the outer arms 1002, 1006 and the inner arms 1004, 1008. Thus, one aspect of the present teaching is that using only four arms with four pivot points still results in synchronized movement of the arms and a significantly more compact form factor when collapsed.

EQUIVALENTS

While the Applicant's teaching is described in conjunction with various embodiments, it is not intended that the Applicant's teaching be limited to such embodiments. On the contrary, the Applicant's teaching encompass various alternatives, modifications, and equivalents, as will be appreciated by those of skill in the art, which may be made therein without departing from the spirit and scope of the teaching.

We claim:

1. A length-adjustable collapsible headphone comprising:
   a) a headband comprising an upper section, a right lower section, and a left lower section, the upper section comprising an inner headband arm and an outer headband arm, the right lower section and the left lower section each comprising a scissor arm assembly having an inner scissor arm and an outer scissor arm, each of the inner scissor arms and the outer scissor arms comprising slide adjustment sub-assemblies;
   b) a pivot joint that connects the outer headband arm to the inner headband arm so that the outer headband arm and the inner headband arm can rotate freely around an axis of the pivot joint;
   c) a left keyhole pivot assembly that connects the inner scissor arm to the outer scissor arm in the left lower section and a right keyhole pivot assembly that connects the inner scissor arm to the outer scissor arm in the right lower section, wherein an axis of the left keyhole pivot assembly and an axis of the right keyhole pivot assembly are each aligned with the axis of the pivot joint so as to maintain a common centerpoint of each of the left keyhole pivot assembly axis, the right keyhole pivot assembly axis, and the axis of the pivot joint, thereby allowing the headphone to collapse in spherical motion to a space efficient closed state; and
   d) at least one earcup assembly connected to at least one of the right and left keyhole pivot assemblies with a yoke using a swivel joint that allows the at least one earcup assembly to yaw around the axis of the swivel joint, the earcup assembly being configured to fit over a user's ear.

2. The length-adjustable collapsible headphone of claim 1, wherein the inner headband arm, outer headband arm, and inner scissor arms and outer scissor arms of the right lower section and the left lower section form a collapsing spherical linkage assembly.

3. The length-adjustable collapsible headphone of claim 1, wherein the at least one earcup assembly comprises an earcup coupled to a yoke using an axel.

4. The length-adjustable collapsible headphone of claim 3, wherein the yoke comprises a ball pin.

5. The length-adjustable collapsible headphone of claim 3 further comprising a cushion positioned on the earcup.

6. The length-adjustable collapsible headphone of claim 5 wherein the cushion is positioned on the earcup with a snapping mechanism.

7. The length-adjustable collapsible headphone of claim 1 wherein the at least one earcup assembly comprises a left and a right earcup assembly.

8. The length-adjustable collapsible headphone of claim 1 wherein the at least one earcup assembly comprises a speakers.

9. The length-adjustable collapsible headphone of claim 1 wherein the at least one earcup assembly comprises a noise suppression material.

10. The length-adjustable collapsible headphone of claim 1 wherein the at least one earcup assembly comprises a cushion material.

11. The length-adjustable collapsible headphone of claim 1 wherein the yoke is detachable.

12. The length-adjustable collapsible headphone of claim 1 further comprising a yoke axel that connects the yoke to the at least one earcup.

13. The length-adjustable collapsible headphone of claim 1 wherein the swivel joint connects to the headband via one of the left and right keyhole pivot assemblies.

14. The length-adjustable collapsible headphone of claim 1 wherein the upper section of the headband comprises a cushion that is positioned under the inner headband arm.

15. The length-adjustable collapsible headphone of claim 1 wherein the inner headband arm and the outer headband arm are formed of injection molded plastic.

16. The length-adjustable collapsible headphone of claim 1 wherein at least one of the pivots, yokes, and earcups are formed of injection molded plastic.

17. A method of collapsing a headphone from an open state to a closed state, the method comprising:
   a) configuring a scissor jack assembly comprising an inner headband arm arranged on an inner sphere and an outer headband arm arranged on an outer sphere, wherein the inner and outer sphere are centered on a common origin, such that the inner headband arm and the outer headband arm are positioned substantially on top of each other and substantially aligned in a same direction, the inner and outer headband arms being connected by a first pivot joint aligned along on a first axis;
   b) disengaging a locking mechanism in a keyhole pivot assembly that connects an inner arm of a lower section of the scissor jack assembly to an outer arm of the lower section of the scissor jack assembly, the keyhole pivot assembly being aligned along a second axis, wherein the first axis and the second axis share the common origin;

c) rotating the inner and outer arm of the lower section of the scissor jack assembly around the second axis using the keyhole pivot assembly such that the arms of the lower section move away from each other and the inner headband arm and the outer headband arm simultaneously rotate around the first axis while maintaining their arrangement on the inner sphere and the outer sphere; and d) halting the rotation of the inner and outer arms of the lower section of the scissor jack assembly when the outer arm of the lower section comes into contact with the outer headband arm.

18. The method of claim 17 further comprising disengaging the locking mechanism by rotating an earcup connected to the keyhole pivot assembly with a ball and pin.

* * * * *